US010300615B2

(12) United States Patent
Votolato et al.

(10) Patent No.: US 10,300,615 B2
(45) Date of Patent: May 28, 2019

(54) UTILITY KNIFE WITH IMPROVED SAFETY FEATURES

(71) Applicants: Earl Votolato, Newport Beach, CA (US); Ryan Burkes, Huntington Beach, CA (US)

(72) Inventors: Earl Votolato, Newport Beach, CA (US); Ryan Burkes, Huntington Beach, CA (US)

( * ) Notice: Subject to any disclaimer, the term of this patent is extended or adjusted under 35 U.S.C. 154(b) by 79 days.

(21) Appl. No.: 15/092,484

(22) Filed: Apr. 6, 2016

(65) Prior Publication Data

US 2017/0291317 A1 Oct. 12, 2017

(51) Int. Cl.

| | |
|---|---|
| ***B26B 29/02*** | (2006.01) |
| ***B26B 3/06*** | (2006.01) |
| ***B26B 3/08*** | (2006.01) |

(52) U.S. Cl.

CPC ..... *B26B 3/06* (2013.01); *B26B 3/08* (2013.01); *B26B 29/02* (2013.01)

(58) Field of Classification Search

CPC ..... B26B 3/08; B26B 29/02; B26B 3/06
USPC ..... 30/162, 151, 320, 335–336, 351, 2, 169
See application file for complete search history.

(56) References Cited

U.S. PATENT DOCUMENTS

| | | | |
|---|---|---|---|
| 1,864,011 | A | 6/1932 | Browm |
| 3,943,627 | A | 3/1976 | Stanley, Jr. |
| 4,091,537 | A | 5/1978 | Stevenson, Jr. |
| 4,757,612 | A | 7/1988 | Peyrot |
| 4,931,042 | A | 6/1990 | Holmes et al. |
| 4,980,977 | A | 1/1991 | Matin et al. |
| 5,241,750 | A | 9/1993 | Chomiak |
| 5,330,494 | A | 7/1994 | van der Westhuizen et al. |
| 5,522,135 | A | 6/1996 | Votolato |
| 5,662,669 | A | 9/1997 | Abidin et al. |
| 5,813,121 | A | 9/1998 | Gringer |
| 5,878,501 | A | 3/1999 | Ownes et al. |
| 5,890,290 | A | 4/1999 | Davis |
| 6,058,607 | A | 5/2000 | Gringer |
| 6,136,013 | A | 10/2000 | Marshall et al. |
| 6,148,520 | A | 11/2000 | Berns |

(Continued)

FOREIGN PATENT DOCUMENTS

| | | |
|---|---|---|
| DE | 3520187 | 12/1986 |
| DE | 8912929.6 | 2/1990 |

(Continued)

*Primary Examiner* — Kenneth E Peterson
*Assistant Examiner* — Nhat Chieu Q Do
(74) *Attorney, Agent, or Firm* — Robert J. Lauson; Aaron P. McGushion; Lauson & Associates

(57) ABSTRACT

The present utility knife provides a uniquely improved safety mechanism that increases safety, reliability, and reduces the cost of manufacturing. A shield is locked over the blade by a strut braced between the shield and a stop within the housing. The strut is biased to the locked position by an integrally molded sinuous spring that is designed to force the strut into engagement with the stop and to force the shield to cover the blade, allowing just one cut per actuator pull. The stop structure checks the motion of the strut when locked and closely guides the movement of the strut when unlocked through use of an L-shaped channel. These features reduce the complexity of the safety knife and increase the reliability of the safety mechanism under rough conditions.

18 Claims, 7 Drawing Sheets

(56) References Cited

U.S. PATENT DOCUMENTS

| | | | | |
|---|---|---|---|---|
| 6,233,832 | B1 | 5/2001 | Berns | |
| D444,368 | S | 7/2001 | Wonderley | |
| 6,263,577 | B1 | 7/2001 | Wonderley | |
| 6,438,849 | B1 | 8/2002 | Wonderley | |
| 6,453,559 | B1 | 9/2002 | Marshall et al. | |
| 6,487,778 | B1 | 12/2002 | Gringer et al. | |
| 6,560,873 | B1 * | 5/2003 | Ortner | B26B 5/00 30/2 |
| 6,578,266 | B2 | 6/2003 | Chomiak | |
| 6,643,936 | B2 | 11/2003 | Carlson et al. | |
| 6,718,637 | B1 | 4/2004 | Ortner et al. | |
| 6,718,640 | B1 * | 4/2004 | John | B26B 5/002 30/151 |
| 6,785,966 | B2 | 9/2004 | Berns | |
| 6,832,438 | B1 | 12/2004 | Gringer et al. | |
| 7,082,688 | B2 | 8/2006 | Votolato | |
| 7,356,928 | B2 | 4/2008 | Votolato | |
| 7,475,480 | B2 | 1/2009 | Votolato | |
| 7,509,742 | B2 | 3/2009 | Votolato | |
| 7,774,942 | B2 | 8/2010 | Schmidt | |
| 7,886,443 | B2 | 2/2011 | Votolato | |
| 8,028,421 | B2 | 10/2011 | Johnson et al. | |
| 8,375,588 | B2 | 2/2013 | Gringer | |
| 8,720,068 | B2 | 5/2014 | Landwehr | |
| 8,997,357 | B2 | 4/2015 | Johnson et al. | |
| 2008/0083119 | A1 * | 4/2008 | Schmidt | B26B 5/00 30/162 |
| 2010/0269348 | A1 * | 10/2010 | Gringer | B26B 5/001 30/2 |
| 2012/0317820 | A1 * | 12/2012 | McGushion | B26B 29/02 30/164 |

FOREIGN PATENT DOCUMENTS

| | | |
|---|---|---|
| EP | 0252711 A1 | 1/1988 |
| WO | 94/04324 | 3/1994 |

* cited by examiner

UTILITY KNIFE WITH IMPROVED SAFETY FEATURES

BACKGROUND

In many personal and industrial applications, safety knives are desirable to prevent user laceration both before a cut is made and immediately subsequent to a cut. These safety knives may be disposable or designed for extended use. The knives that are used for extended periods may have replaceable blades or blade cartridges so that the handle and related safety apparatus may be reused while still maintaining a sharp cutting edge. The disposable knives may have the blade permanently attached to within the safety knife, so that the knife is discarded once the blade becomes dull. For example, the disposable knife is desirable in the food services industry, where loose blades from replaceable blade knives may find their way into the food product. A permanently attached blade forces the user to discard the entire knife rather than just change the blade. To reduce replacement costs incurred by the customer, these disposable knives are often made of inexpensive plastic materials with the least possible number of injection molded parts and moving parts.

Some safety knives have blade covers that may be retracted upon actuation of a trigger or similar actuation means. When locked, these blade covers are prevented from retracting due to the blade cover movement being blocked by a pawl-like mechanism that engages a stop. Only after being disengaged from the stop, can the blade cover be retracted to expose the blade. Some of these newer safety knives further include features that permit just one blade cover retraction for each trigger pull. If the trigger is continuously pressed after the blade cover has been retracted rather than released, the blade cover will still become locked in the extended position. Only after releasing the trigger and depressing the trigger a second time will the blade cover be permitted to retract once again.

The single-use per press feature has been achieved at this point through use of complex mechanisms with many separate parts. For example, much of the art has required the use of separate metal springs to bias parts towards locking. These separate springs and other parts increase the costs of manufacturing and reduce reliability.

Since many of the safety knives are disposable or otherwise have short lives, any added expense greatly detracts from the competiveness of the knife. It is desirable to have a safety knife that is inexpensive to manufacture and more reliable due to the reduction in parts and overall simplification of the mechanism.

SUMMARY

The present utility knife is an entirely new and creative design, offering significant advantages over the prior art. The safety mechanism operates within the utility knife with a blade extending therefrom. A retractable locking shield protects the user from the cutting edge of the blade. When a strut is in a locked position, it is engaged between the shield and a stop so that the shield is prevented from retracting to expose the cutting edge. A spring is integrally molded with the strut to bias the strut towards the locked position. A channel with transverse segments checks the motion of the strut in the locked position and guides the motion of the strut in the unlocked position, as the shield is retracted.

One embodiment of the present utility knife generally comprises a housing with an integrally molded strut and spring that, together with the stop and actuator, controls the motion of a retractable shield. The housing has a blade extending from the housing, a shield retractably extending over a cutting edge of the blade, a stop fixed within the housing, and an actuator extending from the housing. The strut has an integral spring extending from the strut, where the integral spring forms a connection between the strut and the housing to bias the strut towards the shield and towards the stop so that the strut is biased to be braced between the shield and the stop to selectively prevent retracting of the shield. The strut is selectively moved by manual activation of the actuator to disengage the strut from the stop so that retraction of the shield is permitted to expose the cutting edge of the blade, with the integral spring forcing the strut to return to engagement with the stop when the shield is yet again extended over the cutting edge of the blade so that the strut is again braced between the shield and the stop.

As an option, the strut and the integral spring are integrally molded from a plastic material or other appropriate material, with the integral spring extending from a back end of the strut. The integral spring can be a compression spring, such as a sinuous spring. A spring boss can be formed at a distal end of the integral spring, where the spring boss extends laterally relative to the longitudinal axis of the strut. A hollow boss can be fixed within the housing, where the spring boss is inserted into the hollow boss through an open end of the hollow boss, with the open end defining a wall. The hollow boss may include a slot formed through the wall of the hollow boss, with the slot opening into the open end, where the spring boss is inserted into the hollow boss through the open end with a portion of the integral spring being inserted within the slot to prevent substantial rotation of the integral spring about the hollow boss. The sinuous spring can be angled relative to the strut to bias the strut towards the shield and towards the stop. The sinuous spring can be permitted to compress and the sinuous spring can be permitted to bend about the slot in response to a strut displacement.

Again, as an option, a stop engagement boss can extend laterally from the strut, with a stop structure fixed within the housing, where the stop structure has a channel having a first channel portion connected to and transverse to a second channel portion, where the first channel portion forms the stop, and where the stop engagement boss is positioned at least partially within the channel to guide the movement of the strut. The first channel portion may be at a right angle to the second channel portion.

A lift tab may extend from the strut and a lift arm may extend from the actuator, towards the strut, where the lift arm contacts the lift tab upon actuation of the actuator to lift the stop engagement boss from a locked position adjacent to the stop and within the first portion of the channel to alignment with the second portion of the channel in an unlocked position, so that retraction of the shield is permitted to expose the cutting edge of the blade and causing the stop engagement boss to travel within the second portion of the channel.

Figure 1:
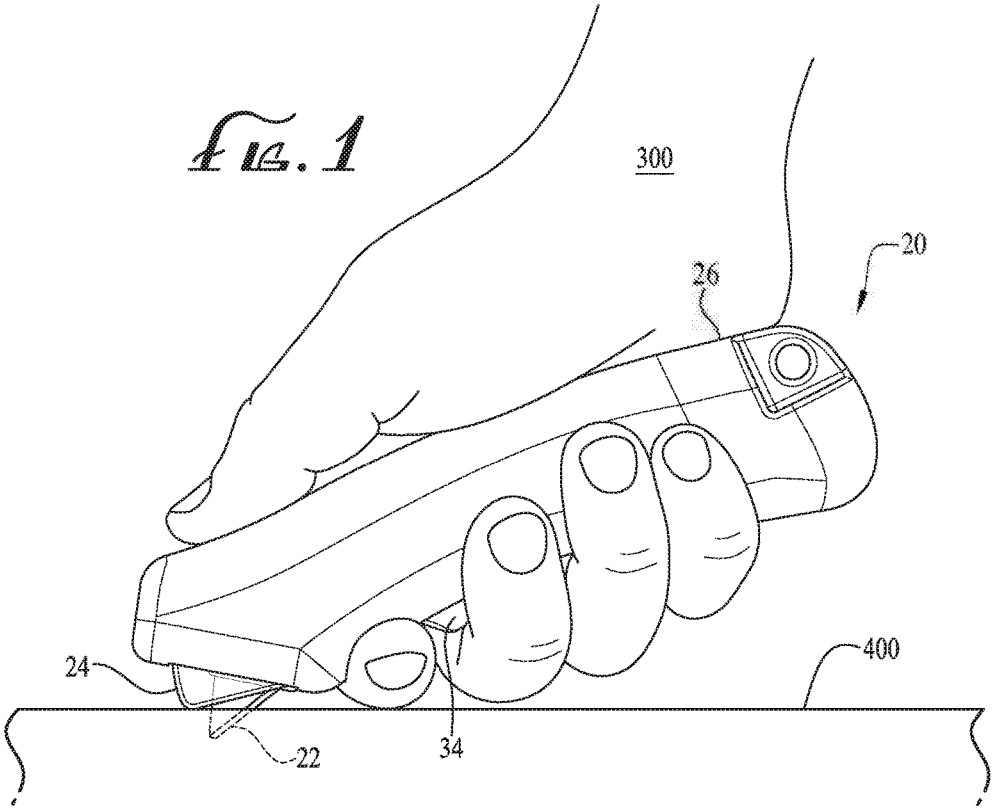
FIG. 1 is a side view of an example embodiment of a utility knife, showing the utility knife held within a user's hand, making a cut.

LISTING OF REFERENCE NUMERALS OF FIRST-PREFERRED EMBODIMENT utility knife 20
blade 22
shield 24, 24'
housing 26
right housing 28
left housing 30
lanyard hole 32
actuator 34
safety mechanism 36
strut 38
sinuous spring 40
spring attachment portion 41
forward end 42
back end 44
stop engagement boss 46, 48
planar face 50, 52
spring stud 54, 56
strut boss 58, 60
lift tab 62, 64
return ramp 66, 68
cantilever spring 70
lift arm 72, 74
tip 73, 75
actuator bearing 76
blade mount 82
hollow post 84, 86
shield journal 88
shield bearing 90, 91
post 92, 94
through hole 96
back 98
hollow boss 100, 102
wall 101, 103
slot 104, 106
spring portion 108
arced groove 110, 111
opening 112, 113
pin 114, 116
wall 118, 120
clearance 122, 124
actuator opening 126, 127
support 128, 130
limiter 132, 134
stop structure 136, 138
channel 140, 142
stop 144, 146
front 148, 150
back 152, 154
shelf 156, 158
fastening structure 160, 162
biased strut component 164
actuator front end 166
actuator back end 167
nook 168
distal end (spring) 170
open end 172, 174
wall 176, 178
first channel portion 180, 182
second channel portion 184, 186
strut top 188
front portion 190, 192
cleanout opening 200
right plate 202
left plate 204
front wall 206
gap 208
user 300
workpiece 400

DESCRIPTION OF THE PREFERRED EMBODIMENTS

An example embodiment of the present utility knife (20) is shown in detail in FIGS. 1-14. In particular, FIG. 1 illustrates the usage of the present utility knife (20) to cut workpiece (400), such as a box or other packaging. The housing (26) of the knife (20) is ergonomically shaped to fit comfortably within the hand of a user (300). The shield (24) is normally locked so that it may not be retracted until the trigger or actuator (34) is manually depressed or otherwise actuated. The user (300) manually presses or pulls the actuator (34) to unlock the shield (24) that is biased to cover the blade (22) and prevents exposure of the cutting edge of the blade (22) when not in use and immediately after use. After depressing the actuator (34), the shield (24) may be rotatably retracted by applying the shield (24) to the workpiece (400) surface, such as the surface of a box or other item to be cut. Upon retraction of the shield (24), the blade (22) may be plunged into the workpiece (400) to a relatively shallow depth, sufficient for cutting into product packaging and the like, without damage to the product within. This depth can be predetermined by the degree of shield (24) retraction, the length of the exposed blade (22), and the user (300) input. The blade (22) may be of a variety of suitable blades, including blades with a straight cutting edge, a hooked or curved cutting edge, or a serrated cutting edge.

Figure 2:
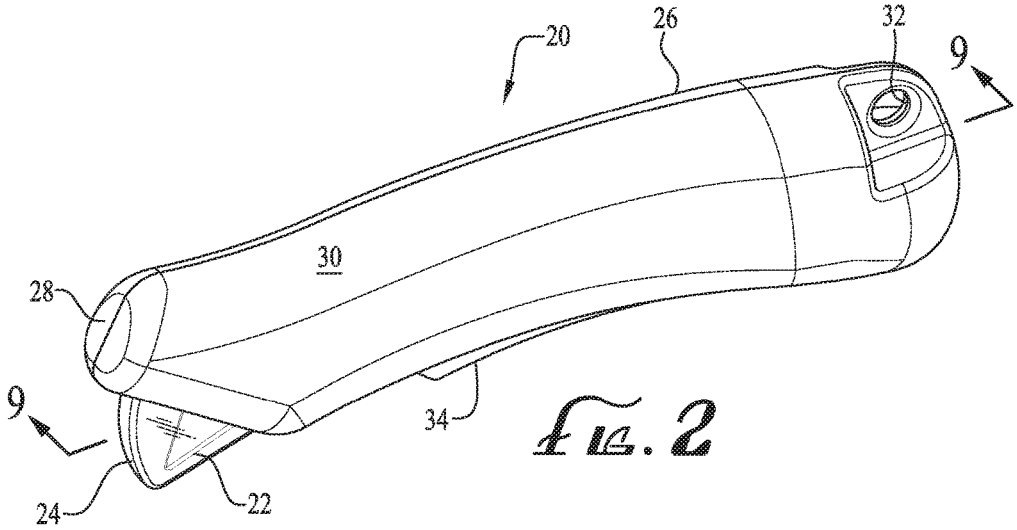
FIG. 2 is a side perspective view of the utility knife of FIG. 1.

Often, users (300) will draw the knife (20) toward themselves during the cutting process. Upon reaching the edge of the workpiece (400) the blade (22) exits the workpiece (400) and the resistive drag of the workpiece (400) on the blade (22) is eliminated, often causing the knife (20) within the user's hand to leave the workpiece (400) with great velocity towards the user's body. The shield (24) is biased to immediately and rapidly extend to cover the blade (22) upon losing contact with the workpiece (400). FIG. 2 illustrates the shield (24) extended to cover the blade (22). At a minimum, the cutting or sharpened edge of the blade (22) should be shielded, such that the user (300) is substantially prevented from contacting the cutting edge of the blade (22). The safety mechanism (36) of the present utility knife (20) is designed to relock the shield (24) upon re-extension of the shield (24), whether the user has released the actuator (34) or has continued to hold the actuator (34) in the depressed or actuated position. This relocking capability whether or not the actuator (34) is actuated is a critical safety feature of the present safety mechanism (36). If the shield (24) were to simply extend over the blade (22) without relocking, the shield (24) would be free to retract once again after leaving the workpiece (400), possibly causing a severe laceration to the user's body. By relocking the shield (24) upon leaving the workpiece (400), the shield (24) will not retract a second time and will protect the user (300) from laceration or other unintended damage to self, others, or property.

For the user's convenience, a lanyard hole (32) may be formed on the back end of the knife (20), opposite the blade (22), for lacing through a lanyard or other cord. The utility knife (20) may also be hung when not in use by hooking a nail or hook through the lanyard hole (32) itself.

Figure 3:
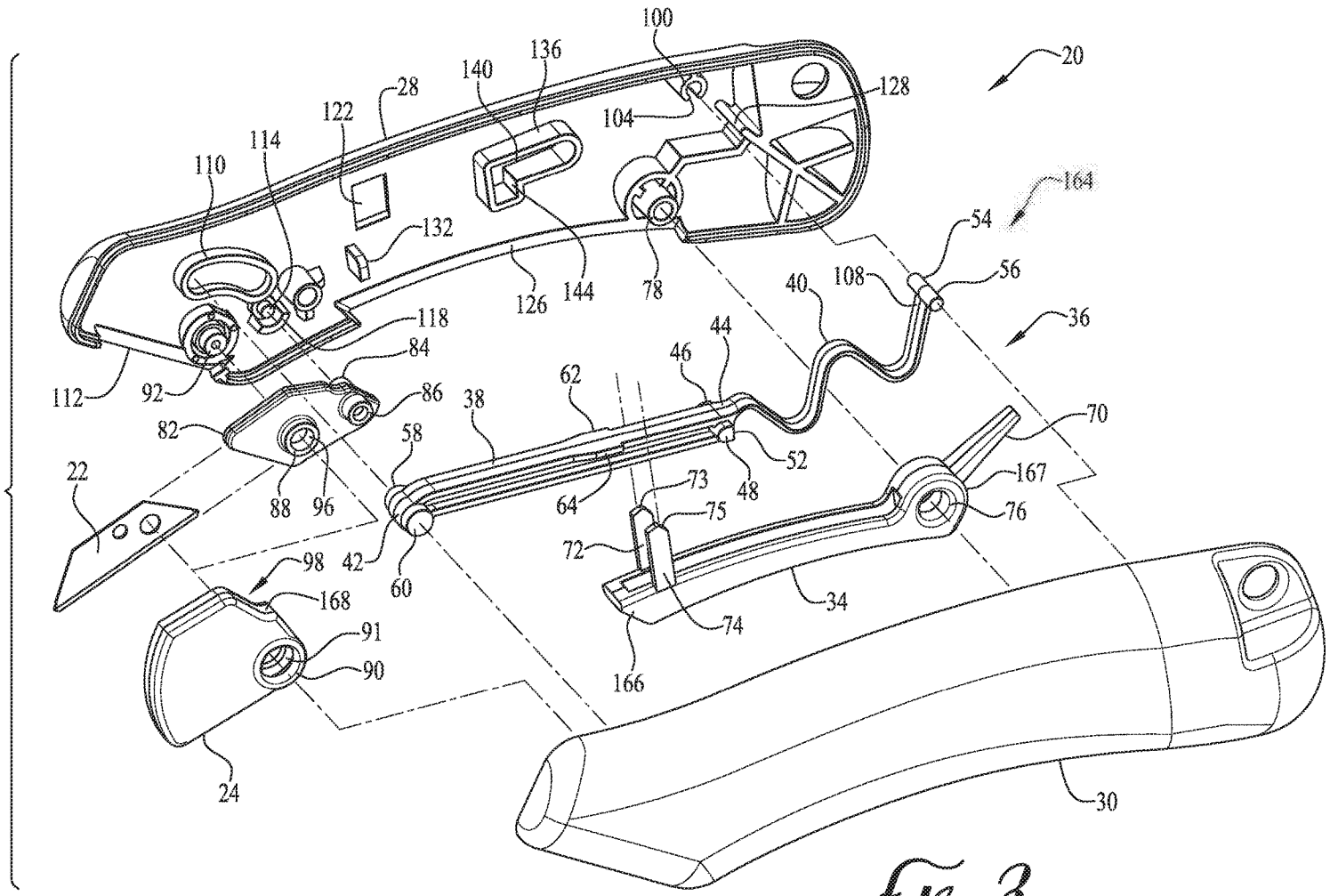
FIG. 3 is an exploded perspective view of the utility knife of FIG. 1, showing the safety mechanism thereof.

An exploded perspective view of the present utility knife (20) is illustrated in FIG. 3, with dashed lines indicating the assembled interrelationships between the various parts. The present embodiment of the utility knife (20) is shown with a right housing (28) that fastens to a corresponding left housing (30) to form a housing (26) with a hollow interior for holding therein the various parts of the safety mechanism (36) and other parts of the knife (20) as detailed herein. The right housing (28) and the left housing (30) may be permanently joined by a snap feature, fasteners, adhesion, or other attachment means, such as ultrasonic welding. With minor variations, such as mirroring of components and other slight modifications the right housing (28) may substantially mirror the construction of the left housing (30). At the forward ends, the right housing (28) has an opening (112) and the left housing (30) has an opening (113), which are formed so that the blade (22) and shield (24) may extend through the combined openings from the interior of the housing (26) to the exterior.

A blade mount (82) is provided for securely holding the blade (22) within the knife (20), with the blade (22) extending from the housing (26). In the illustrated example embodiment, the blade (22) is molded securely within the plastic blade mount (82) through an injection molding process. On each side of the blade mount (82) is a tubular post or shield journal (88) with an axial through hole (96) sized to fit over a post (92) and post (94) formed on the respective interiors of each of the housings (28, 30). The outer diameter of the tubular posts acts a shield journal (88) about which the shield (24) rotates.

The shield (24) is shown with a slot formed in it to accommodate the blade (22) and blade mount (82). A shield bearing (90, 91) having a through hole is formed on the shield (24), and corresponds to the external diameters of the shield journals (88) (the far shield journal being hidden from view) to form a plain bearing, permitting rotation of the shield (24) about the shield journals (88). The back (98) of the shield (24) is configured to contact the strut bosses (58, 60) formed on the forward end (42) of the strut (38) so that the strut bosses (58, 60) contact and follow the back (98) as the shield (24) retracts and extends, similar to a cam and follower relationship. Although not required, the shield (24) is preferably injection molded using a transparent material so that the user may see location of the blade (22) through the extended shield (24). The clear shield (24) also aids in detecting and clearing contamination of the blade (22), as the ability to maintain a clean blade (22) and shield (24) is a desirable feature in the food service industry.

In the illustrated embodiment, four points of attachment are created between the blade mount (82) and the housing (26), to securely hold the blade (22) within the housing (26) and to prevent rotation of the blade (22) when cutting the workpiece (400). Alternate attachment means can be used if movement of the blade (22) is desired. The blade mount (82) is provided with hollow posts (84, 86) on each side. The internal diameter of the hollow post (84) is sized to fit over the pin (114); and an external diameter is sized to be inserted adjacent to and concentric with the curved wall (118), which corresponds to an opposing pin (116) and curved wall (120) on the left housing (30), insuring secure attachment of the blade mount (82) within the assembled housing (26).

The blade mount (82) is preferably injection molded about the metal blade (22), forming an integral blade assembly. The blade (22) may have various holes formed though it that correspond to the hollow posts (84, 86) of the blade mount (82) or for permitting the injected plastic to flow through the holes to further secure the blade (22) to the blade mount (82). The blade mount (82) may be molded from any suitable material, such as nylon, acetal, ABS, or other durable and, optionally, resilient polymers. The blade mount (82) may either be permanently secured within the housing (26) as illustrated in the shown embodiment or may configured to be replaceable, where the blade mount (82) and blade (22) are temporarily secured by a latch mechanism or the like.

The actuator (34) extends through the housing (26) through an opening in the housing (26) defined by the actuator openings (126, 127). The actuator (34) is designed to be manually activated by pushing the actuator (34) further into the housing (26) by grasping the housing (26), with the hand with the fingers on the actuator (34), and depressing the actuator (34) with the fingers by a gripping action. The actuator (34) rotates about actuator journals (78, 80) aligned and extending from the right housing (28) and the left housing (30), with the actuator journals (78, 80) extending though the actuator bearing (76) located on the back end (167) of the actuator (34).

A cantilevered spring (70) is integrally molded on the back end (167) of the actuator (34) and flexes about the back end to bias the actuator (34) out of the housing (26). The free end of the cantilevered spring (70) bears against the supports (128, 130) fixed to the interior of the housing (26). The cantilevered spring (70) is designed to keep the actuator (34) fully extended when not actuated and biased to extension when actuated. As the actuator (34) is depressed, the cantilevered spring (70) provides slight resistance to the user's input. Upon releasing the actuator (34), the cantilevered spring (70) rebounds and returns the actuator (34) to fully extended state.

Figure 4:
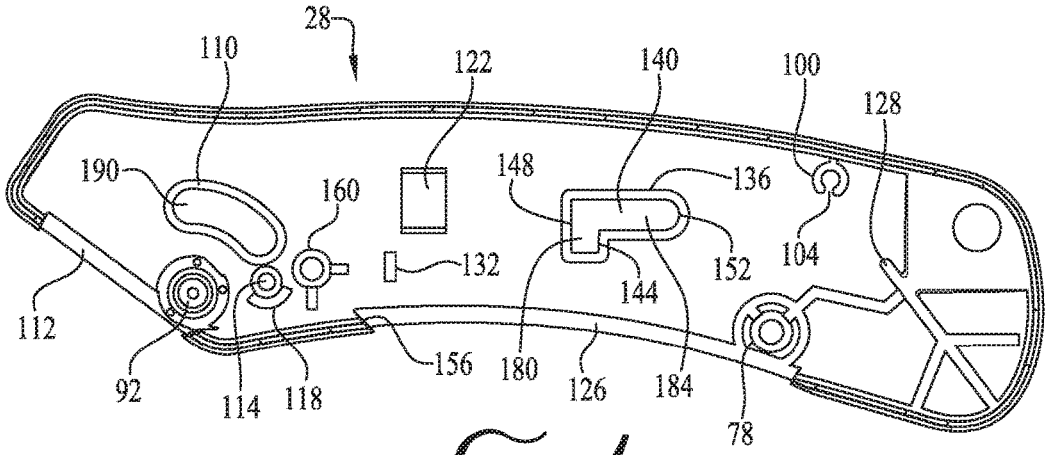
FIG. 4 is a side view of the right housing of the utility knife as shown in FIG. 3, showing the internal details of the right housing.
Figure 5:
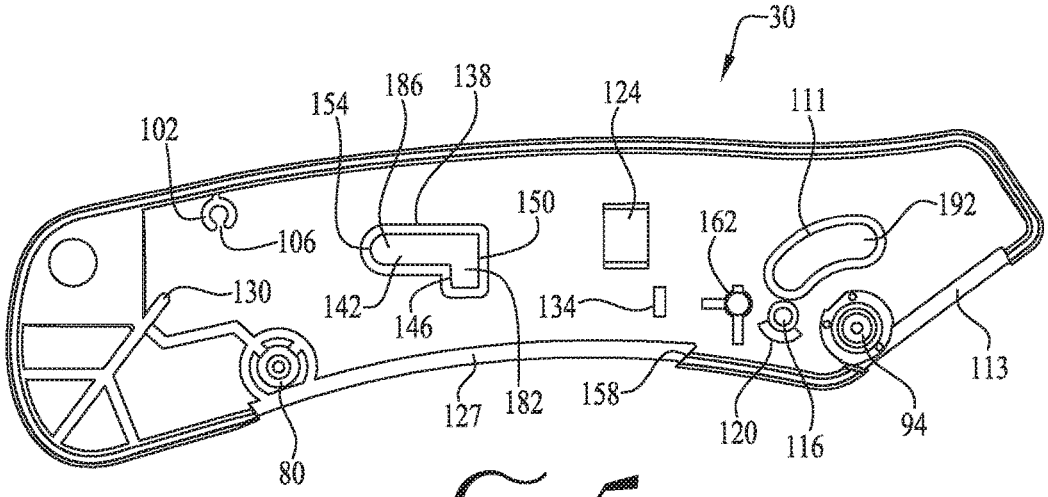
FIG. 5 is a side view of the left housing of the utility knife as shown in FIG. 3, showing the internal details of the left housing.
Figure 6:
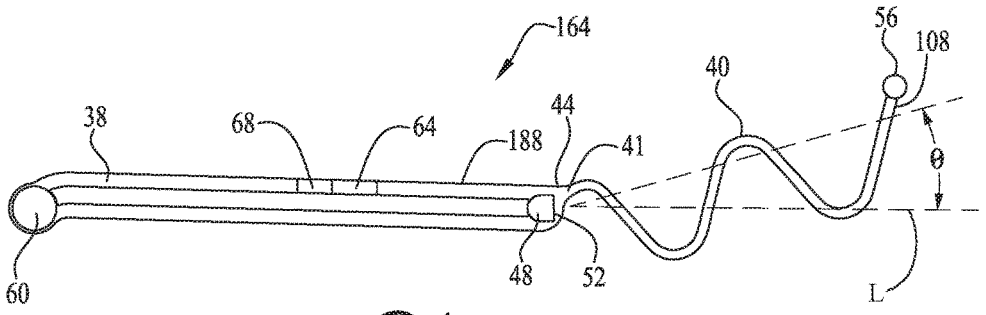
FIG. 6 is a side view of the unitarily formed strut and spring of the utility knife as shown in FIG. 3.
Figure 7:
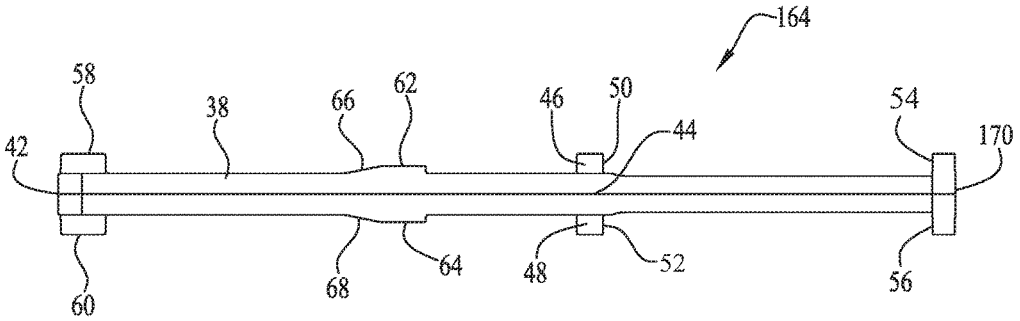
FIG. 7 is a top view of the unitarily formed strut and spring of FIG. 6.
Figure 8:
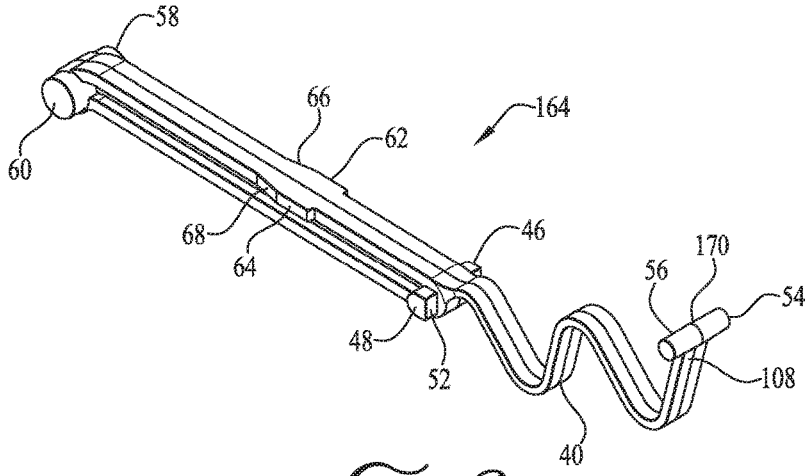
FIG. 8 is a bottom perspective view of the unitarily formed strut and spring of FIG. 6.
Figure 9:
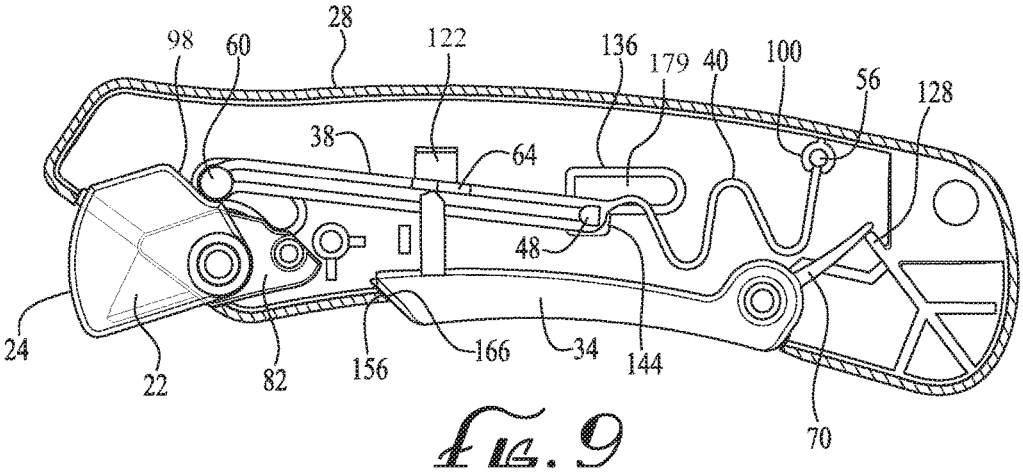
FIG. 9 is a side cross-sectional view of the utility knife as shown in FIG. 2 taken along section 9-9, showing the safety mechanism in an unlocked or safety position with the trigger released.

Also referring to FIGS. 4-5, the front end (166) of the actuator (34) is wedge-shaped and normally rests against the shelves (156, 158) formed at the front of the actuator openings (126, 127), being biased against the shelves (156, 158) by the cantilevered spring (70). Further, the inward movement of the actuator (34) is checked by the limiters (132, 134) fixed to the interior of the housing (26), which prevent the actuator from being pushed into the housing (26) too far. The actuator (34) additionally includes a pair of flexing lift arms (72, 74) extending inwardly towards the strut (38). The lift arms (72, 74) are configured to lift the strut (38) upon actuation, yet flex or splay outwardly apart from one another when strut (38) is forced between the lift arms (72, 74), as will be discussed in greater detail below.

The strut (38) has a forward end (42) and a back end (44), and is generally elongate in shape, with a longitudinal axis (L), and resembling an I-beam in construction. At the forward end (42), a strut boss (58, 60) extends from each side of the strut (38) in a direction generally horizontally transverse or at a right angle to the longitudinal (L) or lengthwise axis of the strut (38). Each strut boss (58, 60) is sized to fit within a corresponding arced groove (110, 111) formed on each of the interiors of the right and left housings (28, 30). The arced grooves (110, 111) may be formed on the interior surface by forming a raised wall to enclose a kidney-shaped or similar arced-shaped area, which is the pathway of the strut bosses (58, 60) as the shield (24) is retracted. Under the bias of the sinuous spring (40), the strut bosses (58, 60) normally push upon the back (98) of the shield (24) to bias the shield (24) to extend over the blade (22), where the strut bosses (58, 60) are located at the forward end of the arced grooves (110, 111). As the shield (24) is retracted, the back (98) contacts and pushes the strut bosses (58, 60) and strut (38) in the direction of the stop (144) against the bias of the sinuous spring (40). When the shield (24) is fully extended over the blade (22), the strut bosses (58, 60) rest within the small nook (168), where the strut (38) is braced between the nook (168) on the back (98) of the shield (24) and the stop (144).

The strut (38) further includes a pair of stop engagement bosses (46, 48) which extend from each side of the back end (44) of the strut (38) in a direction generally horizontally transverse or at a right angle to the longitudinal axis (L) of the strut (38). On each stop engagement boss (46, 48) is formed a stop engagement face or planar face (50, 52) which is generally parallel to the face of the stop (144, 146) and situated adjacent to the stop (144), such that pressure on the shield (24) will force the strut (38) back towards the stop (144) creating contact between the planar faces (50, 52) of the stop engagement bosses (46, 48), blocking movement of the strut (38) back, preventing the shield (24) from retracting. Although the stop engagement boss (46, 48) is described as having a planar face (50, 52), the face may be any appropriate shape, where the motion of the strut (38) is still checked by the stop (144, 146).

The strut (38) additionally includes a pair of lift tabs (62, 64) which extend from each side of the strut (38), between the front end (42) and the back end (44). On the lateral side of each lift tab (62, 64) is a return ramp (66, 68) merging the lateral side of the lift tab (62, 64) with the side of the strut (38) towards the strut boss (58, 60). The operation of the lift tabs (62, 64) and the return ramps (66, 68) will be discussed in greater detail below.

Referring to FIGS. 3 and 6-8, it can be seen that the strut (38) is integrally molded with a spring (40), with the spring (40) extending from the back end of the strut (38) to form a biased strut component (164). In an alternate embodiment, the spring (40) may also be securely attached to the strut (38) using an attachment means such as an adhesive, welding, a mortise and tenon joint, a dovetail joint or other interlocking joint, and so on. In the illustrated example embodiment, the spring (40) is a sinuous spring, in which the spring (40) has several undulations, zig-zags, or has a serpentine shape, or the like. The biased strut component (164) is preferably injection molded as a uniform and continuous part. The sinuous spring (40) is angled relative to the longitudinal axis of the strut (38) by the angle θ, in part, so that the sinuous spring (40) applies a spring force vector on the strut (38) that that biases the strut (38) in two directions, forward toward the shield (24) and down toward the stop (144, 146). The angle θ may vary according to the amount of force proportioned to each component (forward and down) of the spring force, and may be angled to position the spring stud (54, 56) in alignment with the hollow boss (100, 102). The sinuous spring (40) is generally ribbon-like so that the width of the sinuous spring (40) generally resists lateral flexure or bowing; yet the thickness of the sinuous spring (40) permits bending and longitudinal compression and expansion by collapsing or expanding the undulations.

A pair of spring studs (54, 56) are formed at the distal end (170) of the sinuous spring (40), extending laterally from the sinuous spring (40). The spring studs (54, 56) insert within their respective hollow bosses (100, 102) fixed to the interior of the housing (26). The hollow bosses (100, 102) each have a slot (104, 106) through the wall of the hollow boss (100, 102) that receives a portion (108) of the sinuous spring (40). In this way, the distal end (170) of the sinuous spring (40) is fixed to the housing (26) due to the spring studs (54, 56) being captured within the opposing hollow bosses (100, 102). And the distal end (170) of the sinuous spring (40) is prevented from rotating relative to the hollow bosses (100, 102) due to the portion (108) of the sinuous spring (40) being inserted through the slot (104, 106).

Looking back at FIG. 3, the safety mechanism (36) of the present utility knife (20) comprises the actuator (34) and the biased strut component (164), which interacts with the various parts of the remainder of the utility knife (20), such as the stop structure (136, 138) and the shield (24), to lock the shield (24) over the blade (22) unless the actuator (34) has been sufficiently depressed by the user. Additionally referring to the example of FIGS. 4-5, the right housing (28) and the left housing (30) are preferably substantially mirror opposites of one another, except in some details such as the opposing fastening structures (160, 162) or where differing structure is required. The right housing (28) and the left housing (30) join together to form the housing (26) with a hollow interior for enclosing much of the safety mechanism (36). Each housing (28, 30) may have a depression or clearance (122, 124) cut or formed in the inner walls to provide clearance for the operation of the safety mechanism (36), to prevent interference with the housings (28, 30) when the lift arms (72, 74) flex outwardly.

A stop structure (136, 138) is fixed within the interior of the housing (26) on each of the right housing (28) and the left housing (30). The stop structure (136, 138) is generally comprised of a channel (140, 142), with a first channel portion (180, 182) continuous with and transverse to a second channel portion (184, 186). Preferably, the first channel portion (180, 182) is on the same plane as the second channel portion (184, 186), so that they share a common bottom floor (179) without a step or ramp to transition between the first channel portion (180, 182) and the second channel portion (184, 186). As can be seen in FIGS. 4-5, the channel (140, 142) is L-shaped, where the first channel portion (180, 182) is transverse at an approximate right angle to the second channel portion (184, 186). Although a right angle is shown, other angles are possible, so long as the stop engagement boss (46, 48) is permitted to securely engage or press upon the stop (144, 146) to check the motion of the strut (38); and the stop engagement boss (46, 48) is permitted to travel within the channel (140, 142) as the strut (38) moves. The channel (140, 142) is defined in the illustrated example by a wall extending from the interior of each housing (28, 30). However, the channel (140, 142) may also be defined by a groove cut or formed in each housing (28, 30).

The first channel portion (180, 182) is located at the front portion (148, 150) of the channel (140, 142); and the second channel portion (184, 186) is located at the back portion (152, 154) of the channel (140, 142). The stop (144, 146) is located on the back wall of the front portion (148, 150) of the channel (140, 142). The stop (144, 146) is preferably a planar wall that is opposed to the front portion (190, 192) of the arced groove (110, 111), so that when the strut boss (58, 60) is positioned in the front portion (190, 192), the strut (38) is braced between the stop (144, 146) and the back (98) of the shield (24) to lock the shield (24) over the blade (22) in a locked position.

FIGS. 9-12 show the present knife (20) in cross section along its length, as indicated in FIG. 2, and illustrate the operation of the safety mechanism (36) as the actuator (34) is depressed and the shield (24) is rotated. First, looking at FIG. 9, the actuator (34) is not actuated and is fully extended, being biased out of the housing (26) by the cantilevered spring (70). The utility knife (20) is shown in the locked position, where the shield (24) securely covers the blade (22) due to the strut (38) being braced between the back (98) of the shield (24) and the stop (144, 146), checking the motion of the strut (38) and the shield (24).

Figure 10:
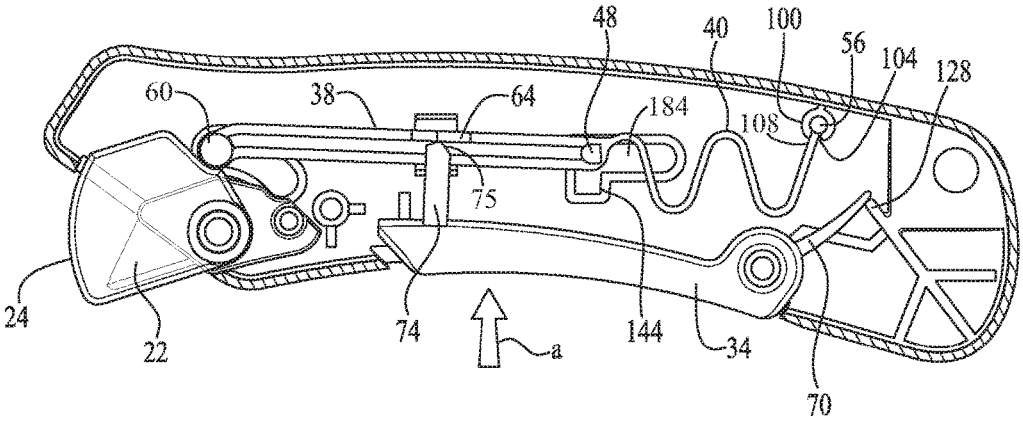
FIG. 10 is a side cross-sectional view of the utility knife as shown in FIG. 9, showing the trigger depressed to lift the strut against the bias of the integral spring into an unlocked position.

FIG. 10 shows the actuator (34) being depressed against the bias of the cantilevered spring (70) by an external force as shown by arrow (a), usually generated by the user's hand. The tips (73, 75) of the lift arms (72, 74) are located directly beneath the lift tabs (62, 64). As the actuator (34) is depressed, the tips (73, 75) contact the lift tabs (62, 64) to lift the strut (38), so that the stop engagement boss (46, 48) is lifted above the stop (144, 146) to align the stop engagement boss (46, 48) with the second channel portion (184, 186), in an unlocked position where the blade cover (24) is permitted to retract to expose the blade (22) if a retracting force is applied to the blade cover (24). When the actuator (34) is depressed, the strut (38) is lifted above the stop (144, 146) by slightly rotating (counterclockwise when viewing FIG. 10) the strut (38) about the strut boss (58, 60), so that the stop (144, 146) can be bypassed as it no longer obstructs the movement of the strut (38). In this unlocked configuration, the user (300) is permitted to begin cutting the workpiece (400) by applying the shield (24) to the workpiece surface to cause retraction of the shield (24). The sinuous spring (40) has been deflected slightly, bending the spring (40) in the clockwise direction about the hollow boss (100, 102), where the spring (40) is substantially prevented from rotating about the spring stud (54, 56) due to the spring portion (108) being trapped within the slot (104, 106). The depression of the actuator (34) lifts the strut (38) against the downward force of the sinuous spring (40).

Figure 11:
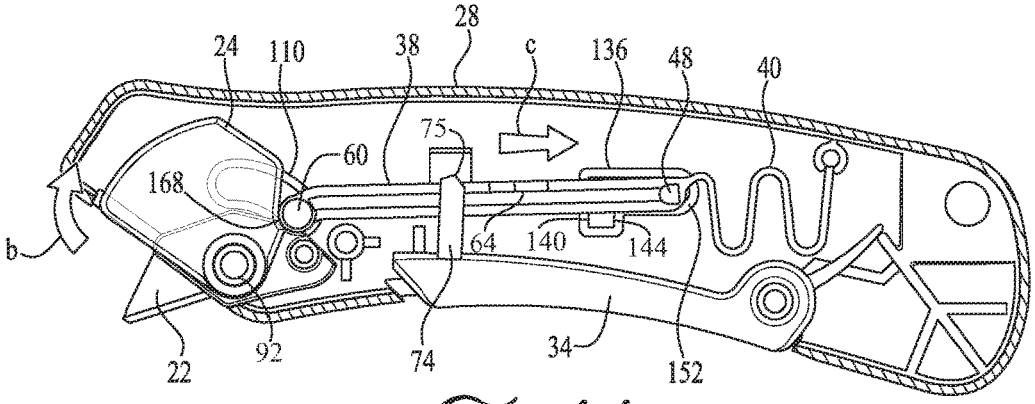
FIG. 11 is a side cross-sectional view of the utility knife as shown in FIG. 9, showing the shield fully retracted and the strut fully longitudinally displaced relative to the bracket, compressing the integral spring.

As the shield (24) is retracted in FIG. 11, as indicated by arrow (b), the shield (24) is rotated clockwise as viewed from the illustration, about the shield bearing (92, 94) to expose the blade (22). The strut boss (58, 60) is restricted to travel within the arced groove (110. 111), so that the strut (38) may travel in the forward and back directions and rotate about the strut boss (58, 60), where the strut (38) both rotates and translates. Because movement of the stop engagement boss (46, 48) is no longer blocked by the stop (144, 146), the strut (38) is permitted to move back as indicated by arrow (c), with the stop engagement boss (46, 48) traveling within the second channel portion (184, 186). As the strut (38) moves back towards the back (152, 154) of the second channel portion (184, 186) of the channel (140, 142), the tip (73, 75) of the lift arm (72, 74) loses contact with the lift tab (62, 64) and the strut (38) will then slide between the lift arms (72, 74) when the user continues to depress the actuator (34). The lift arms (72, 74) are no longer engaged with the lift tabs (62, 64) and are unable to lift the strut (38), even if the user releases the actuator (34) and depresses the actuator (34) once again during the time the shield (24) remains retracted. The sinuous spring (40) is even further deflected, with the undulations compressed and the spring (40) generally bent about the hollow boss (100, 102).

Figure 12:
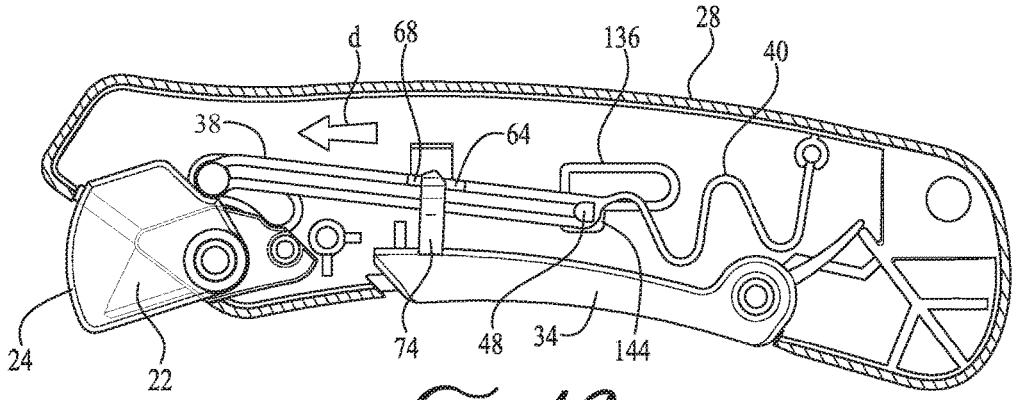
FIG. 12 is a side cross-sectional view of the utility knife as shown in FIG. 9, showing the shield fully extended over the blade and the strut moved longitudinally forward and adjacent with the stop in the locked position, with the trigger still depressed

FIG. 12 illustrates that once a cut has been completed and the shield (24) is removed from the workpiece (400), the shield (24) is biased by the sinuous spring (40), through the strut (38), to immediately and quickly extend back over the blade (22) and back into a locked position, as indicated by arrow (d), to protect the user and surrounding area from cutting exposure to the blade (22), even though the actuator (34) remains depressed. The spring attachment portion (41) is the portion of the sinuous spring (40) that extends from the strut (38). The spring attachment portion (41) extends from the back end (44) of the strut (38) at an upward angle θ from the longitudinal axis (L), where upward in this example is the direction above the stop (144, 146) and towards the second channel portion (184, 186). The spring attachment portion (41) extending from the back end (44) at an angle, aids in applying a spring force on the strut (38) both in the direction of the shield (24) and in the direction of the stop (144, 146).

Because the lift arms (72, 74) are no longer able to lift the strut (38) and the strut (38) is located between the lift arms (72, 74), the strut (38) can drop back down towards the stop (144, 146) as the strut (38) is forced forward and down by the sinuous spring (40). As the strut (38) moves forward, pushing the shield (24) closed to cover the blade (22), the return ramp (66, 68) spreads the lift arms (72, 74) causing them to flex outwardly as the lift arms (72, 74) slide up their respective return ramps (66, 68). In this way, if the user continues to depress the actuator (34) after a cut has been made and the shield (24) re-extended to cover the blade (22), the shield (24) is locked in the extended state and cannot be retracted again until the user fully releases the actuator (34) and depresses the actuator (34) once again. This one cut per actuator (34) pull is due to the lift arms (72, 74) sliding out of lifting engagement with the lift tabs (62, 64) of the strut (38) and because the lift arms (72, 74) flex outwardly as they ride up the return ramp (66, 68), preventing the lift arms (72, 74) from lifting the strut (38) again after re-extension of the shield (24) and permitting the strut (38) to be repositioned back into the locked position by the sinuous spring (40). Thus, after the lift arms (72, 74) slide out of lifting engagement with the lift tabs (62, 64), the user must pull the actuator (34) once again to unlock the knife (20), after the shield (24) re-extends. The knife (20) will remain locked until the user (300) releases the actuator (34) and depresses the actuator (34) a second time.

Figures 13, 14:
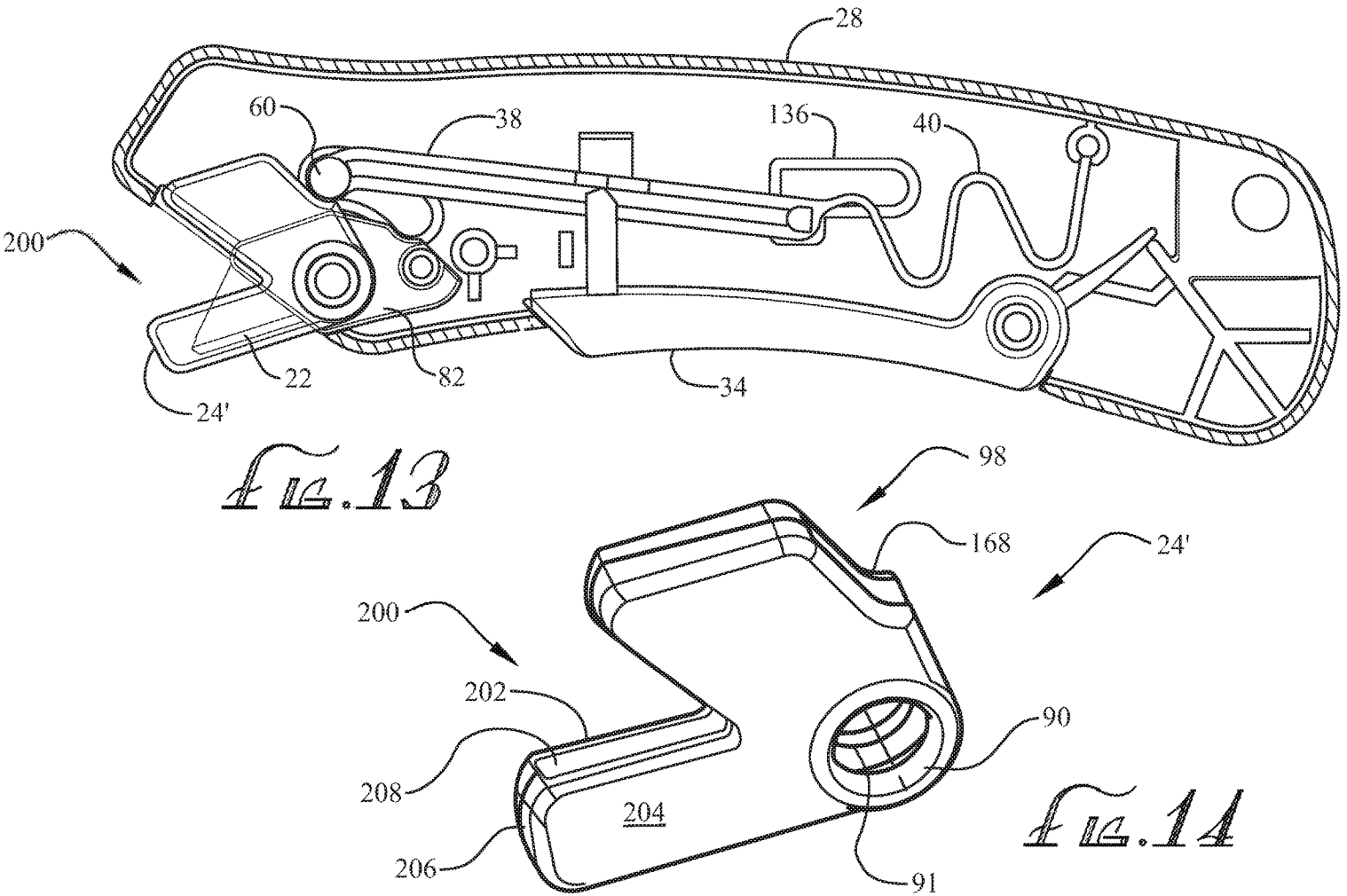
FIG. 13 is a side cross-sectional view of the utility knife as shown in FIG. 2 taken along section 9-9, with an alternate embodiment of the shield fitted over the blade.
FIG. 14 is a perspective view of an alternate embodiment of the shield.

FIGS. 13-14 illustrate an alternate embodiment of the shield (24'), with a cleanout opening (200). As the user cut the workpiece (400), especially cardboard and other paper products, the portion of the workpiece (400) at the cut may begin to tear and crumble, depending on the material condition, the blade sharpness, and the speed of the cut. In an example of cutting a cardboard box, the paper linerboard or corrugations may crumble and tear free of the box and be jammed into the shield (24'), preventing proper operation of the shield, and reducing safety and convenience. If paper or other debris is caught within a standard shield, it is difficult or even unsafe to remove. Thus, it may be more prudent to dispose of the knife rather than to clean out the shield.

The shield (24') shown in FIGS. 13 and 14 generally includes a right plate (202) spaced apart from a left plate (204), with a gap (208) in between for shielding the cutting edge of the blade (22) from contact when the utility knife (20) is locked. A wall (206) spans between the right plate (202) and the left plate (204) to maintain the gap (208) and further shield the blade (22). A notch is transversely formed through the right plate (202) and the left plate (204) to form the cleanout opening (200). As cutting debris is forced into the blade opening (the opening through which the blade (22) extends from the shield (24') when making a cut), the debris can be accessed and cleared from the shield (24') through the cleanout opening (200). Because the cutting edge of the blade (22) is covered and the knife (20) is locked, the user may safely pry, pinch, or otherwise grip the caught debris through the cleanout opening (200) with the use of tools or by hand, quickly removing the debris from the shield (24'). The user may clear debris from the shield (24') in a quick motion in between cuts, saving time and increasing safety and performance.

The strut (38) and the sinuous spring (40), being injection molded or otherwise formed as a single unit, creates unique advantages over existing knife technology. The number of individual parts are reduced and assembly is made easier. The safety mechanism (36) is made more reliable, since the spring constant and properties can be more closely managed to insure continuity in performance among a large number of knives (20). Also, the reliance on outside metal spring manufactures is reduced, along with the inherent variability in metal spring supply. Additionally, the incidence of parts dislodging under rough or extreme conditions is greatly reduced by the unitary strut (38) and spring (40) design. Furthermore, the improved stop structure (136, 138) controls the motion of the strut (38), and again, prevents dislodging or misalignment of the strut (38) during rough use or inversion.

What is claimed is:

1. A utility knife comprising:

a housing with a blade extending from the housing, a shield retractably extending over a cutting edge of the blade, a stop structure fixed within the housing, and an actuator extending from the housing, the stop structure comprising a channel with a first channel portion connected to and transverse to a second channel portion, a stop being formed within the first channel portion;

a strut with an integral spring extending from the strut, the strut comprising a forward end defined nearest to the shield and a back end opposite the forward end and nearest to the stop, the integral spring extending from the back end of the strut and forming a connection between the strut and the housing to impart a pushing bias on the strut towards the shield and towards the stop so that the strut is biased to be braced between the shield and the stop to selectively prevent retracting of the shield, the movement of the strut guided by the channel; and a stop engagement boss extends laterally from the strut near the back end, the stop engagement boss positioned at least partially within the channel to guide the movement of the strut;

wherein the strut is selectively moved by manual activation of the actuator to disengage the strut from the stop by moving the stop engagement boss out of alignment with the stop, where the movement of the actuator causes the stop engagement boss to move into alignment with the second channel portion before retraction of the shield is permitted to expose the cutting edge of the blade, the integral spring forcing the strut to return to engagement with the stop when the shield is yet again extended over the cutting edge of the blade so that the strut is again braced between the shield and the stop.

2. The utility knife of claim 1 wherein the strut and the integral spring are integrally molded from a plastic material, with the integral spring extending from a back end of the strut.

3. The utility knife of claim 2 wherein the integral spring is a compression spring.

4. The utility knife of claim 3 wherein the integral spring is a sinuous spring.

5. The utility knife of claim 2 wherein a spring boss is formed at a distal end of the integral spring, the spring boss extending laterally relative to a longitudinal axis of the strut.

6. The utility knife of claim 5 wherein a hollow boss is fixed within the housing, the spring boss is inserted into the hollow boss through an open end of the hollow boss, the open end defining a wall.

7. The utility knife of claim 6 wherein the hollow boss includes a slot formed through the wall of the hollow boss, the slot opening into the open end, the spring boss is inserted into the hollow boss through the open end with a portion of the integral spring being inserted within the slot to prevent substantial rotation of the integral spring about the hollow boss.

8. The utility knife of claim 7 wherein the integral spring is a sinuous spring, the strut and the sinuous spring are integrally molded from a plastic material, with the integral spring extending from a back end of the strut, the sinuous spring being angled relative to the strut to bias the strut towards the shield and towards the stop.

9. The utility knife of claim 8 wherein the sinuous spring is permitted to compress in response to a strut displacement, and the sinuous spring is permitted to bend about the slot in response to a strut displacement.

10. The utility knife of claim 1 wherein the first channel portion is at a right angle to the second channel portion.

11. The utility knife of claim 1 wherein a lift tab extends from the strut and a lift arm extends from the actuator and towards the strut, the lift arm contacts the lift tab upon actuation of the actuator to lift the stop engagement boss from a locked position adjacent to the stop and within the first channel portion to alignment with the second channel portion in an unlocked position so that retraction of the shield is permitted to expose the cutting edge of the blade and causing the stop engagement boss to travel within the second channel portion.

12. A utility knife comprising:

a housing with a blade extending from the housing, a shield retractably extending over a cutting edge of the blade, and an actuator extending from the housing;

a stop structure is fixed within the housing, the stop structure having a channel comprising a first channel portion connected to and transverse to a second channel portion, the first channel portion comprising a stop; and a strut with a stop engagement boss extending laterally from the strut and an integral spring extending from the strut, a forward portion of the strut defined nearest to the shield and a back portion of the strut defined opposite the forward portion, the stop engagement boss extending from the back portion and positioned at least partially within the channel to restrict the movement of the stop engagement boss to the channel, the strut being biased towards the shield and towards the stop to position with the stop engagement boss adjacent to the stop, so that the strut is normally braced between the shield and the stop to selectively prevent retracting of the shield, the integral spring forming a connection between the strut and the housing to impart a pushing bias on the strut towards the shield and towards the stop so that the strut is biased to be braced between the shield and the stop to selectively prevent retracting of the shield, the movement of the strut guided by the channel;

wherein the strut is selectively moved by activation of the actuator to lift the stop engagement boss from a locked position adjacent to the stop within the first channel portion to alignment with the second channel portion in an unlocked position so that retraction of the shield to the extent that the cutting edge of the blade is exposed is permitted only thereafter, where the cutting edge of the blade is exposed and the stop engagement boss is forced to travel within the second channel portion.

13. The utility knife of claim 12 wherein the stop engagement boss comprises a planar face that is positioned adjacent to and parallel to the stop when the strut is in the locked position.

14. The utility knife of claim 12 wherein the first channel portion is at a right angle to the second channel portion.

15. The utility knife of claim 12 wherein the spring is a sinuous spring, the strut and the sinuous spring are integrally molded from a plastic material, with the spring extending from a back end of the strut.

16. The utility knife of claim 15 wherein a spring boss extends from a distal end of the sinuous spring, a hollow boss is fixed within the housing, the spring boss is inserted into the hollow boss through an open end of the hollow boss, the open end defining a wall, the wall having a slot formed therethrough, the spring boss is inserted into the hollow boss through the open end with a portion of the sinuous spring being inserted within the slot to prevent substantial rotation of the integral spring about the hollow boss.

17. A utility knife comprising:

a housing with a blade extending from the housing, a shield retractably extending over a cutting edge of the blade, and an actuator extending from the housing;

a stop structure is fixed within the housing, the stop structure having a channel comprising a first channel portion connected to and transverse to a second channel portion, the first channel portion comprising a stop; and a strut with an integrally molded sinuous spring and a stop engagement boss, a forward end of the strut defined nearest to the shield and a back end of the strut defined opposite the forward end, the stop engagement boss extending from the back end and positioned at least partially within the channel to restrict the movement of the stop engagement boss to the channel, the integral spring forming a connection between the strut and the housing to impart a pushing bias on the strut towards the shield and towards the stop to position with the stop engagement boss adjacent to the stop, so that the strut is normally braced between the shield and the stop to selectively prevent retracting of the shield, the movement of the strut guided by the channel;

wherein, when the shield is fully extended, the strut is selectively moved by activation of the actuator to lift the stop engagement boss from a locked position adjacent to the stop within the first channel portion to alignment with the second channel portion in an unlocked position so that retraction of the shield is permitted once the stop engagement boss is aligned with the second channel portion, exposing the cutting edge of the blade and causing the stop engagement boss to travel within the second channel portion.

18. The utility knife of claim 17 wherein a spring boss extends from a distal end of the sinuous spring, a hollow boss is fixed within the housing, the spring boss is inserted into the hollow boss through an open end of the hollow boss, the open end defining a wall, the wall having a slot formed therethrough, the spring boss is inserted into the hollow boss through the open end with a portion of the sinuous spring being inserted within the slot to prevent substantial rotation of the integral spring about the hollow boss.

* * * * *